United States Patent [19]

Okumura

[11] Patent Number: 4,492,198

[45] Date of Patent: Jan. 8, 1985

[54] ADVANCING MECHANISM FOR INTERNAL COMBUSTION ENGINES

[75] Inventor: Shigeo Okumura, Iwata, Japan

[73] Assignees: Yamaha Hatsudoki Kabushiki Kaisha; Sanshin Kogyo Kabushiki Kaisha, both of Japan

[21] Appl. No.: 583,272

[22] Filed: Feb. 27, 1984

Related U.S. Application Data

[63] Continuation of Ser. No. 347,583, Feb. 10, 1982, abandoned.

[30] Foreign Application Priority Data

Mar. 10, 1981 [JP] Japan ..... 56-34141

[51] Int. Cl.[3] ..... F02P 5/02

[52] U.S. Cl. ..... 123/413; 123/403

[58] Field of Search ..... 123/413, 395, 400, 403

[56] References Cited

U.S. PATENT DOCUMENTS

| | | | |
|---|---|---|---|
| 2,094,860 | 10/1937 | Timian et al. | 123/413 |
| 2,103,348 | 12/1937 | Boyce | 123/413 |
| 2,256,948 | 9/1941 | Lloyd et al. | 123/395 |
| 3,769,949 | 11/1973 | Elingsen | 123/413 |
| 3,807,372 | 4/1974 | Garcea | 123/413 |
| 4,071,002 | 1/1978 | Frahm | 123/413 |

FOREIGN PATENT DOCUMENTS

| | | | |
|---|---|---|---|
| 613866 | 12/1960 | Italy | 123/413 |
| 204342 | 7/1939 | Switzerland | 123/413 |

*Primary Examiner*—Andrew M. Dolinar
*Attorney, Agent, or Firm*—Ernest A. Beutler

[57] ABSTRACT

Two embodiments of ignition timing mechanism wherein a timing curve is generated in response to the position of the throttle valve. In each embodiment the timing is advanced on progressive opening of the throttle valve until a predetermined maximum advance is obtained at a position less than wide-open throttle. The timing is then retarded from the maximum advanced position as the throttle valve is continued to open to its wide-open throttle position. In each embodiment the timing is retarded beyond the maximum advanced position to a predetermined advanced position prior to fully wide-open throttle position and this advance is held during the remainder of opening of the throttle valve.

9 Claims, 3 Drawing Figures

ADVANCING MECHANISM FOR INTERNAL COMBUSTION ENGINES

This application is a continuation of application Ser. No. 347,583, filed Feb. 10, 1982, now abandoned.

BACKGROUND OF THE INVENTION

This invention relates to an ignition angle advancing mechanism for internal combustion engines, and more particularly to an improved ignition timing system and method.

Most internal combustion engines embody an ignition timing mechanism for timing the ignition so as to achieve maximum torque throughout the engine load range. This is achieved commonly through the use of a throttle operated advance mechanism so that the spark advance is controlled in relation to throttle opening. For example, in outboard engines a timing plate carries the timing mechanism and is rotatably supported relative to the crankshaft for altering engine timing in response to throttle valve opening. The most commonly employed throttle timing advance curve has a fixed static advance that is maintain up until a predetermined throttle opening. Once this throttle opening is reached, the timing is advanced until a maximum timing advance is achieved and this is maintained until wide-open throttle. Under partial load running with the throttle less than fully opened, there is a relatively low combustion temperature and flame propagation in the chamber and the advance spark timing provided by conventional timing mechanism is desirable to achieve maximum torque. However, it has been discovered that under wide-open throttle conditions and maximum speed that there is sufficient flame propagation that performance and fuel economy are actually deteriorated by the maximum spark advance provided by conventional mechanisms.

It is, therefore, a principal object of this invention to provide an improved spark timing mechanism for an internal combustion engine.

It is a further object of this invention to provide a structure and method for controlling spark timing that permits maximum torque to be achieved throughout the engin speed and load ranges.

It is a further object of this invention to provide an improved, simplified spark timing mechanism that will achieve the desired spark timing consistent with engine requirements.

SUMMARY OF THE INVENTION

This invention is adapted to be embodied in a timing mechanism for an internal combustion engine that comprises means for initiating ignition, timing means for altering the timing of the ignition, a throttle valve, and means for interrelating the operation of the timing means with the position of the throttle valve. In accordance with this feature of the invention, the interrelating means is effective to advance the ignition timing upon a predetermined degree of opening of the throttle valve to a predetermined maximum throttle advance and to thereafter retard the timing from the maximum advance upon continued opening of the throttle valve.

Another feature of the invention is adapted to be embodied in a method for operating an internal combustion engine wherein the spark timing is advanced during a predetermined degree of throttle opening to a maximum advance and is, thereafter, retarded upon continued opening of the throttle valve toward its wide-opened position.

DETAILED DESCRIPTION OF THE PREFERRED EMBODIMENTS

Figure 1:
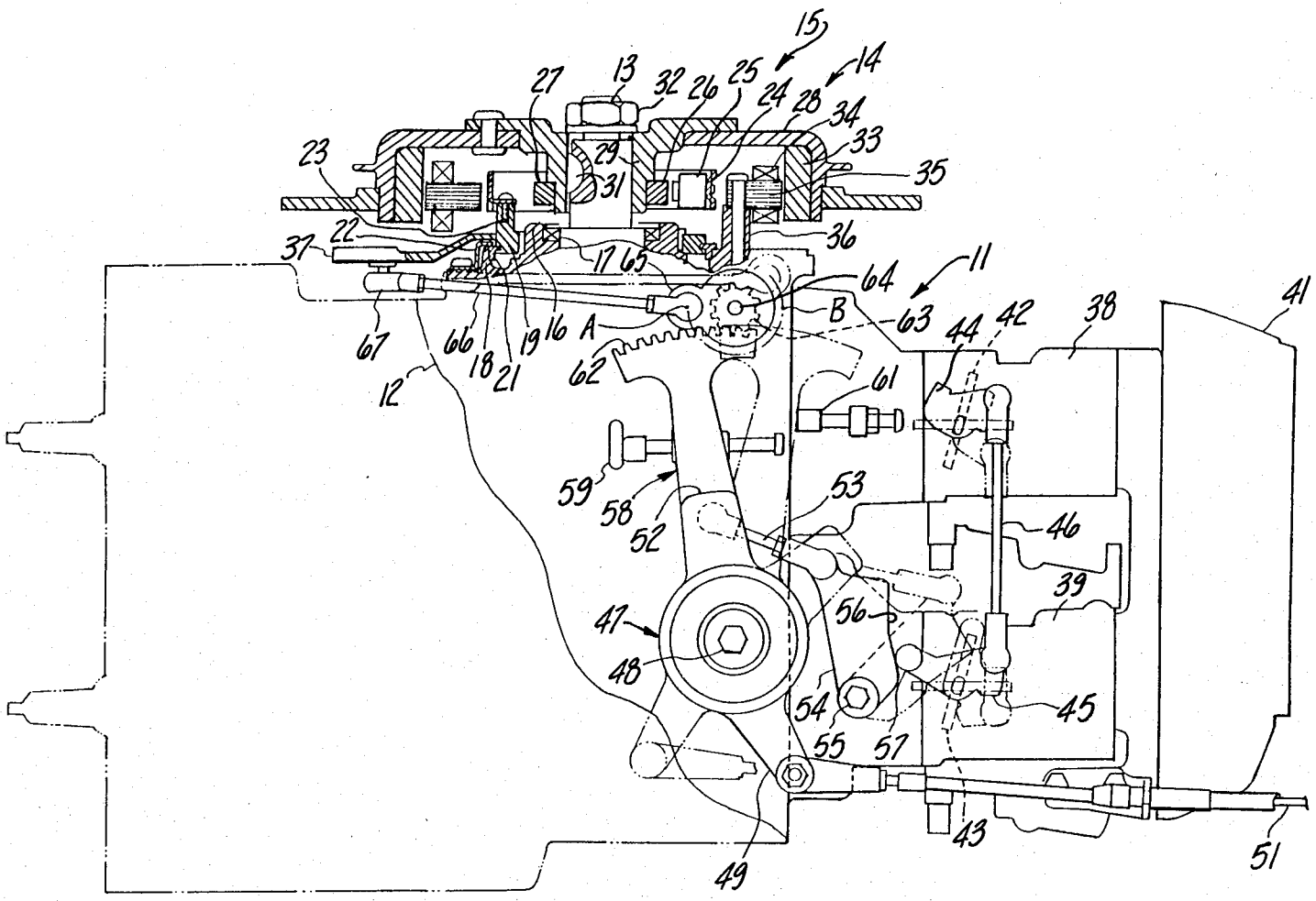
FIG. 1 is a side elevational view, with portions broken away and other portions shown in section, of an internal combustion engine having a timing mechanism constructed in accordance with a first embodiment of the invention.

Referring first to FIG. 1, an internal combustion engine constructed in accordance with a first embodiment of this invention is identified generally by the reference numeral 11. The engine 11 may be of any known type but in the illustrated embodiment is comprised of a two-cylinder outboard motor. The engine 11 includes a main body assembly 12 in which a crankshaft 13 (only shown partially) is supported for rotation about a vertically extending axis. Although the invention is described with such an engine configuration, it should be apparent to those skilled in the art that certain aspects may be employed in conjunction with engine of other types.

Associated with the upper end of the crankshaft 13 is a magneto, indicated generally by the reference numeral 14, and a spark triggering and advance mechanism, indicated generally by the reference numeral 15. The upper wall of the engine body assembly 12 is formed with a projecting portion 16 that encircles the crankshaft 13 and which supports a suitable seal 17. Outwardly of the projection 16, the upper wall is formed with a second circumferential projection 18 with a cylindrical recess being formed between the projections 16 and 18. A timing plate or table 19 is rotatably journaled in this recess. The support is provided by means of generally t-shaped retainers 21 that are affixed to the plate 19 and which are held relative to the end wall by means of generally L-shaped clips 22.

The plate 19 has upwardly extending projections 23 that are affixed to a ring or holder 24 to which a pulser coil 25 is affixed. The pulser coil 25 is juxtaposed to permanent magnets 26 and 27 that are affixed, in a manner to be described, to the crankshaft 13. There will be employed a number of permanent magnets that are equal to the number of cylinders or the number of separate firing pulses demanded by the engine 11.

An inverted cup shaped member 28 has a hub portion 29 that is non-rotatably affixed to the crankshaft 13 by means including a key 31. A nut 32 is affixed to the crankshaft 13 to axially locate the member 28 relative to the crankshaft 13. The interior of the cup-shaped member 28 supports an annular permanent magnet 33 that cooperates with one or more generating coils 34 that are wound around armatures or posts 35 which are, in turn, affixed to the engine body by means of mounting bases 36.

The permanent magnets 26 and 27 of the timing and advance mechanism 15 are carried by the magneto hub portion 29 in any suitable manner. As is well known with this type of mechanism, rotation of the magneto member 28 will cause a potential to be generated and a spark will be initiated when the pulser 25 comes into proximity with either of the magnets 26 or 27.

The spark timing is altered in response to the position of the throttle valves of the engine 11. For this purpose an arm 37 is affixed to and extends outwardly from the table or plate 19 for rotating the plate 19 and pulser coil 25 in response to opening of the throttle valves.

The engine 11 is provided with a pair of carburetors 38 and 39 that draw an air charge through an air inlet device 41 and form a fuel air charge for delivery to the cylinders of the engine 11. Throttle valves 42 and 43 are positioned in the induction passages of the carburetors 38 and 39 for controlling the flow therethrough. An actuating lever 44 is affixed to the throttle valve shaft of the throttle valve 42 and an actuating lever 45 is affixed to the throttle valve shaft of the throttle valve 43. The actuating levers 44 and 45 are interconnected for simultaneous rotation by means of a link 46 that is pivotally connected at its opposite ends to the levers 44 and 45.

A throttle actuating lever, indicated generally by the reference numeral 47, is rotatably supported on the engine body 12 by means of a pivot shaft 48. The lever 47 has a first arm 49 that is connected to the wire of a Bowden wire actuater 51 for rotation of the lever 47 upon operator control of the wire 51. The lever 47 has a second arm 52 that is connected by means of a link 53 to a throttle actuating cam 54. The cam 54 is rotatably supported upon the intake manifold of the engine by means of a shaft 55 and has a cam surface 56 that engages a follower 57 on the lever 45 so as to rotate the lever 45 and throttle valves 42 and 43 upon movement of the throttle control lever 47. The solid line view in this figure shows the throttle mechanism with the throttle valves 42 and 43 in their idle position whereas the phantom line view shows the mechanism as it appears when the throttle valves 42 and 43 at their wide open throttle position.

A timing control lever, indicated generally by the reference numeral 58, is journaled upon the shaft 48 in proximity to the throttle control lever 47. The timing control lever has an idle position that is determined by an adjustable stop 59. The timing control lever 58 is normally biased in a clockwise direction by a spring (not shown) into engagement with a lug (not shown) on the throttle control lever 47. As a result, when the throttle control lever 47 is rotated toward its throttle opening position, the timing control lever 58 will be rotated in the same direction. The timing control lever 58 follows movement of the throttle control lever 47 until the timing control lever 58 contacts a second adjustable stop 61 provided on the engine. Further opening movement of the throttle valves 42 and 43 will, under this condition, not be followed by continued rotation of the timing control lever 58.

The outer end of the timing control lever 58 is formed with a sector gear 62 that is engaged with a pinion gear 63 that is, in turn, rotatably supported on the engine body 12 by means of a shaft 64. The pinion gear 63 is rotatably affixed to a crank 65 having an arm that is pivotally connected to one end of a timing control link 66. The opposite end of the link 66 has a pivotal connection 67 to the timing control arm 37.

In operation, as the throttle control lever 47 is rotated in a clockwise direction to open the throttle valves 42 and 43, the timing control arm 58 will initially be rotated in a clockwise direction away from the stop 59 and by the action of the spring. Upon this rotation the pinion gear 63 will rotate in a counterclockwise direction around the shaft 64 and the crank 65 will draw the link 66 from its neutral position indicated by the point A. This movement of the link will cause the timing control arm 37 to rotate and rotate the pulser 25 in a direction so as to advance the timing. The timing will continue to advance upon opening of the throttle valves 42 and 43 until the crank pivotal connection to the link 66 passes the point B. Upon continued rotation of the crank 65 past this point, the link 66 will be moved back toward the left since its pivotal connection to the crank 65 has now passed over center. Thus, upon continued opening of the throttle valves 42 and 43, past the point corresponding to the point B of the crank 65, the timing will be retarded. This retardation in timing will occur until the timing control lever 58 contacts the stop 61. At this point continued opening of the throttle valves 42 and 43 by rotation of the throttle control lever 47 will not cause corresponding pivotal movement of the timing control lever 58. As the throttle control lever 47 moves away from the timing control lever 58, the lug on the throttle control lever 47 will move away from the timing lever 58.

When the throttle valves 42 and 43 are closed from their wide open position, the throttle control 47 will move in a counterclockwise direction and the timing control lever 58 will be held against the stop 61 by the spring. When the lug on the throttle control lever 47 engages the timing control lever 58 due to continued closing of the throttle valves 42 and 43, the timing control lever 58 will thereafter follow the closing movement of the throttle control lever 47.

Figure 2:
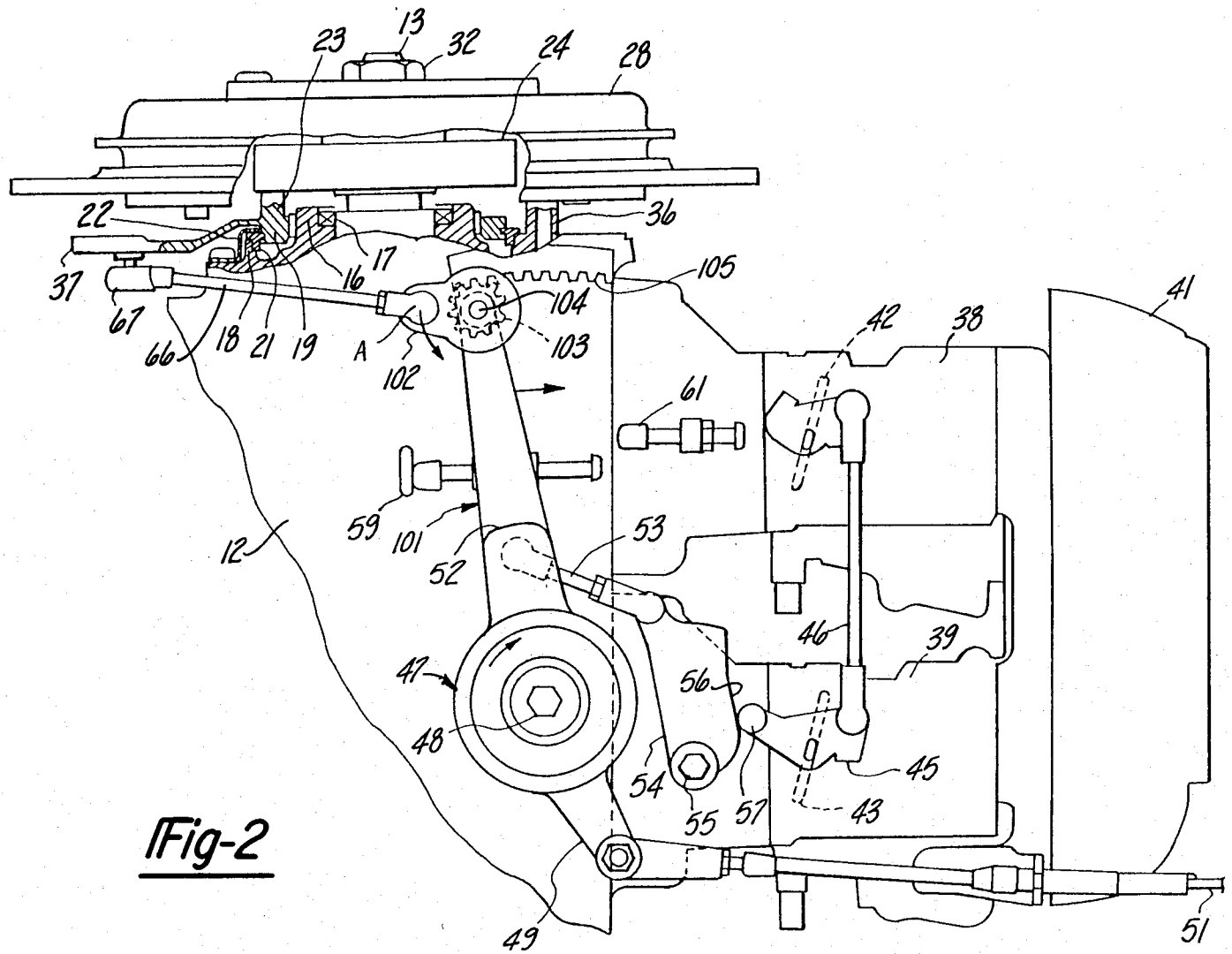
FIG. 2 is an enlarged partial view, in part similar to FIG. 1, and shows a second embodiment of the invention.

FIG. 2 illustrates another embodiment of the invention. This embodiment differs only from the previously described embodiment in the interrelationship between the throttle control lever 47 and the timing plate 19. For that reason only these components of this embodiment will be described in detail. The components which are the same as the preceeding embodiment have been identified by the previously used reference numerals and the description of these components will not be repeated except insofar as is necessary to understand the operation of this embodiment.

In this embodiment a timing control lever, indicated generally by the reference numeral 102, is rotatably supported on the shaft 48. The timing control lever is, as in the previously described embodiment, rotatable between two position determined by the stops 59 and 61. In addition, as in the previously described embodiment, the throttle control lever 47 and timing control lever 101 are interrelated for simultaneous movement by means of a spring and lug on the throttle lever 47 (not shown).

A crank 102 and interconnected pinion gear 103 are rotatably journaled at the outer end of the timing control lever 101 on a pivot shaft 104. The pinion gear 103 meshes with a sector gear 105 that is affixed in any suitable manner to the engine body 12. In this embodiment when the throttle control lever 47 is rotated in a throttle opening direction, the spring will cause the timing control lever 101 to rotate in a clockwise direction. Upon such clockwise rotation the pinion gear 103 will move along the sector gear 105 and rotate the crank 102 so as to pull the link 66 and rotate the timing plate 19 and pulser carried thereby in an advancing direction. The spark advance continues until the crank 102 has gone over center and then the timing will be retarded until the timing control lever 101 contacts the stop 61.

As in the previously described embodiment, continued opening of the throttle valves 42 and 43 will cause the throttle lever 47 to move relative to the timing lever 101 and the timing will be held at a fixed point that is less than the maximum advance.

In addition to advancing the timing by the rotation of the crank 102, it should be noted that in this embodiment the crank 102 is also moved to the right by the rotation of the timing control lever 101. Thus, the actual timing advance will be a function of both the rotary movement of the crank 102 about the pivot shaft 104, and the degree of angular movement of the pivot shaft 104. Thus, this arrangement permits a different advancing curve than the previously described embodiment.

Figure 3:
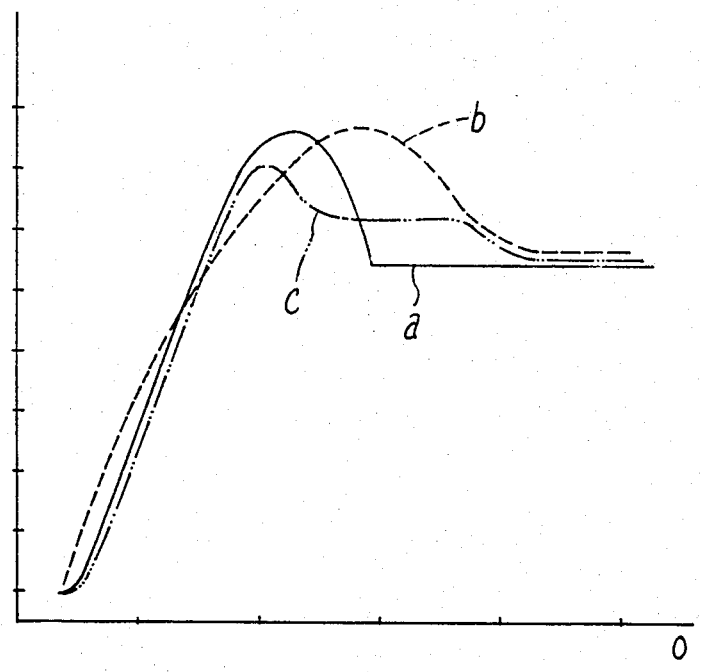
FIG. 3 is a graphical representation of the spark timing in relation to throttle valve opening in accordance with the embodiments of this invention.

The timing characteristics of the two embodiments disclosed are shown graphically in FIG. 3 as is the ideal timing arrangement demanded by an engine of a predetermined type. In this figure the ordinate indicates the angle $\theta$ of opening of the throttle valves 42 and 43 while the abscissa indicates the spark timing in relation to the top dead center of the piston. The curve "c" indicates the optimum timing in relation to throttle valve position for a typical engine. The curve "a" indicates the timing characteristics of the embodiment of FIG. 1 and the curve "b" indicates the timing of the embodiment of FIG. 2. It should be readily apparent that each embodiment provides a timing curve that more closely approximates that demanded by the engine than the timing mechanism heretofore employed. Specifically, it should be noted that the demanded timing curve falls off from the peak advance whereas previously proposed timing mechanisms have provided spark advance up to a maximum and held that maximum during the remainder of the throttle valve opening.

It should be readily apparent that two arrangements have been disclosed that provide slightly different timing characteristics, however, each provides a retarded spark from the maximum spark advance when the throttle valve has opened beyond a predetermined degree. It should be readily apparent to those skilled in the art that other timing curves embodying this principle may be achieved using other types of interconnecting linkage systems. Furthermore, although the invention has been disclosed in conjunction with a pulser coil contactless type of ignition system, it can be used in conjunction with any of the well known conventional type ignition systems including mechanically operated points, optical sensors or the like. Various other changes and modifications may be made without departing from the spirit and scope of the invention, as defined by the appended claims.

I claim:

1. In a timing mechanism for an internal combustion engine comprising means for initiating ignition, timing means for altering the timing of said ignition by means of a movable element, a throttle valve, an operating member mechanically connected to said throttle valve for positioning said throttle valve, and means for interrelating the operation of said timing means with the position of said throttle valve, the improvement comprising said interrelating means including means providing a mechanical connection between said operating member and said movable element being effective to move said movable element in a direction to advance the ignition timing from a predetermined position as said throttle valve is opened to a predetermined maximum advance and thereafter moving said movable element in a direction to retard the ignition timing from said maximum advance upon continued opening of said throttle valve to a fixed advance intermediate of said maximum advance and said predetermined position at an opening of said throttle valve less than its wide-open position and permit continued movement of said operating member without further movement of said movable element to retain said fixed advance during continued opening of said throttle valve until wide-open throttle position is reached.

2. A timing mechanism as set forth in claim 1 wherein the interrelating means includes a crank movable to an over center position for retarding the timing.

3. A timing mechanism as set forth in claim 2 wherein the timing means includes a rotatably supported plate.

4. A timing mechanism as set forth in claim 3 further including lost motion means interposed between the throttle valve and the timing means for permitting continued opening of the throttle valve to its wide-open position without changing the timing of the timing means.

5. A timing mechanism as set forth in claim 2 further including a shaft to which the crank is affixed, a pinion gear affixed to said shaft, a sector gear meshing with said pinion gear for rotating said shaft, and means for operatively connecting said sector gear to the throttle valve for rotating said sector gear upon opening of said throttle valve.

6. A timing mechanism as set forth in claim 5 wherein the means for rotating the sector gear upon opening of the throttle valve includes a lost motion connection for ceasing rotation of said sector gear when said throttle valve reaches the less than wide-open position.

7. A timing mechanism as set forth in claim 1 further including adjustable stop means for adjustably determining the fixed advance set by the timing mechanism.

8. A timing mechanism as set forth in claim 2 further including adjustable stop means for adjustably determining the fixed advance set by the timing mechanism.

9. A timing mechanism as set forth in claim 6 further including adjustable stop means engageable with said sector gear for adjustably limiting the rotation of said sector gear and the fixed advance of the timing mechanism.

* * * * *